US011982026B2

(12) United States Patent
Jhunjhunwala

(10) Patent No.: US 11,982,026 B2
(45) **Date of Patent: *May 14, 2024**

(54) WOVEN TEXTILE FABRIC

(71) Applicant: Sachin Jhunjhunwala, Mumbai (IN)

(72) Inventor: Sachin Jhunjhunwala, Mumbai (IN)

( * ) Notice: Subject to any disclaimer, the term of this patent is extended or adjusted under 35 U.S.C. 154(b) by 67 days.

This patent is subject to a terminal disclaimer.

(21) Appl. No.: 17/994,107

(22) Filed: Nov. 25, 2022

(65) Prior Publication Data

US 2024/0117534 A1 Apr. 11, 2024

(30) Foreign Application Priority Data

Sep. 29, 2022 (IN) ..... 202221055978

(51) Int. Cl.

| | |
|---|---|
| ***D03D 15/47*** | (2021.01) |
| ***D03D 15/225*** | (2021.01) |
| ***D03D 15/283*** | (2021.01) |
| ***D03D 15/49*** | (2021.01) |
| *D03D 1/00* | (2006.01) |

(52) U.S. Cl.

CPC ..... *D03D 15/225* (2021.01); *D03D 15/283* (2021.01); *D03D 15/49* (2021.01); *D10B 2331/04* (2013.01); *D10B 2401/063* (2013.01)

(58) Field of Classification Search

CPC .... D03D 15/47; D03D 13/008; D03D 15/225; D03D 15/283; D10B 2201/22; D10B 2331/04

See application file for complete search history.

(56) References Cited

U.S. PATENT DOCUMENTS

| | | | | |
|---|---|---|---|---|
| 10,669,651 | B2 * | 6/2020 | Gupta | D03D 15/47 |
| 2017/0159214 | A1 | 6/2017 | Sundararajan | |
| 2020/0056309 | A1 * | 2/2020 | Gupta | D03D 15/283 |

FOREIGN PATENT DOCUMENTS

| | | | | | |
|---|---|---|---|---|---|
| CN | 105155099 | A | | 12/2015 | |
| CN | 105887283 | B | | 11/2017 | |
| CN | 107805868 | A | * | 3/2018 | |
| CN | 109183250 | A | * | 1/2019 | D03D 15/56 |
| CN | 109763242 | A | * | 5/2019 | |
| CN | 110541230 | A | * | 12/2019 | |
| CN | 110468484 | B | * | 11/2020 | D01D 5/092 |
| CN | 214083230 | U | | 8/2021 | |
| CN | 214354651 | U | | 10/2021 | |
| CN | 103726176 | A | | 1/2022 | |
| CN | 113897782 | A | | 1/2022 | |

* cited by examiner

*Primary Examiner* — Robert H Muromoto, Jr.

(74) *Attorney, Agent, or Firm* — The Roy Gross Law Firm, LLC; Roy Gross

(57) ABSTRACT

A woven textile fabric, the fabric including: a 100% Lyocell warp spun yarn with a yarn count of 30s to 80s; and a 100% recycled multifilament textured polyester weft yarn with a denier of 10D to 140D, wherein the total content of recycled polyester in the fabric is at least about 35%, further wherein the fabric exhibits rating of 2 or above when the fabric is tested for pilling after 1000 rubs. The advantageous fabric realized in accordance with embodiments of the present disclosure has excellent wrinkle resistance, high tensile strength, and low pilling tendency.

6 Claims, No Drawings

WOVEN TEXTILE FABRIC

TECHNICAL FIELDS

The present disclosure pertains generally to the field of textile industry. More specifically, the present disclosure pertains to a woven textile fabric with higher thread count that exhibits low pilling tendency, while being economical.

BACKGROUND

Background description includes information that may be useful in understanding the present invention. It is not an admission that any of the information provided herein is prior art or relevant to the presently claimed invention, or that any publication specifically or implicitly referenced is prior art.

Often in textile manufacturing, it becomes necessary to scrap products for one reason or another. For example, it could be that the products, once manufactured, did not meet the desired specifications, or perhaps, the product was not as marketable as anticipated. Further textiles used by the consumer are thrown into the landfills have become a big global problem. Apparel made from natural fibers takes years to decompose, whereas man-made fibers do not self-decompose. Woolen clothes do decompose but release methane and carbon dioxide into the atmosphere. This contributes towards global warming. Synthetic fabrics in the landfill release nitrous oxide which is a powerful greenhouse gas. Besides, toxic substances pollute groundwater and surrounding soil.

With increasing demand and problems associated with the decomposition of Apparel, recycling and reusing textiles, fibers, and waste materials is an effective way to build sustainability in the apparel industry. Numerous recycled textile fabrics are reported in the literature and are available in market, which are used by retailers and consumers. However, these recycled textile fabrics are of low quality, non-durable, and exhibit poor elasticity, chemical resistance, tensile strength, pilling, and the likes.

There is, therefore, a need in the art to provide a new and improved textile fabric that is comfortable, breathable, wrinkle resistant, exhibits high strength and low piling that can find utility as a home textile. The present disclosure satisfies the existing needs, as well as others, and alleviates the shortcomings associated with conventional recycled fabrics.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability.

OBJECTS

An object of the present disclosure is to provide a woven textile fabric that overcomes the deficiencies associated with the conventional woven textile fabric.

Another object of the present disclosure is to provide a woven textile fabric that has high thread count.

Another object of the present disclosure is to provide a woven textile fabric that exhibits high tensile strength.

Another object of the present disclosure is to provide a woven textile fabric that exhibits low pilling tendency.

Another object of the present disclosure is to provide a woven textile fabric that is durable, wrinkle resistant, and comfortable to human skin.

Another object of the present disclosure is to provide a woven textile fabric that is economical and easy to manufacture.

Another object of the present disclosure is to provide a woven textile fabric that has enhanced aesthetic characteristics and can be used in a variety of applications.

SUMMARY

The present disclosure pertains generally to the field of textile industry. More specifically, the present disclosure pertains to a woven textile fabric with higher thread count that exhibits low pilling tendency, while being economical.

An aspect of the present disclosure relates to a woven textile fabric, said fabric comprising: a 100% Lyocell warp spun yarn with a yarn count of 30s to 80s; and a 100% recycled multifilament textured polyester weft yarn with a denier of 10D to 140D, wherein the total content of recycled polyester in the fabric is at least about 35%, further wherein said fabric exhibits rating of 2 or above when the fabric is tested for pilling after 1000 rubs.

In some embodiments, the fabric comprises 70 to 200 ends per square inch (EPI) Lyocell spun yarns. In some embodiments, the fabric comprises 62 to 1300 picks per square inch (PPI) recycled multi-filament textured polyester yarns. In some embodiments, the recycled multi-filament textured polyester yarn comprises 5 to 50 filaments. In some embodiments, the fabric has a total thread count ranging from 132 to 1500. In some embodiments, the fabric is of a twill weave, a satin weave or a percale weave. In some embodiments, the recycled multi-filament textured polyester yarns are wound, substantially parallel to one another and substantially adjacent to one another, on a multi-pick yarn package at an angle between 15 and 45 degrees and at a type A shore hardness between 50 to 90 to enable simultaneous insertion of the multi-filament polyester yarns during a single pick insertion event of a pick insertion apparatus of a loom.

The woven textile fabric of the present disclosure can find utility as a bedding product, the bedding product being selected from a bed sheet, a pillow case, a comforter, a coverlet, a pillow sham, a dust ruffle, a blanket, a bedspread, and a duvet cover.

Various objects, features, aspects and advantages of the inventive subject matter will become more apparent from the following detailed description of preferred embodiments, along with the accompanying drawing figures in which like numerals represent like components.

DETAILED DESCRIPTION

The following is a detailed description of embodiments of the disclosure depicted in the accompanying drawings. The embodiments are in such detail as to clearly communicate the disclosure. However, the amount of detail offered is not intended to limit the anticipated variations of embodiments; on the contrary, the intention is to cover all modifications, equivalents, and alternatives falling within scope of the present disclosure.

Each of the appended claims defines a separate invention, which for infringement purposes is recognized as including equivalents to the various elements or limitations specified in the claims. Depending on the context, all references below to the "invention" may in some cases refer to certain specific embodiments only. In other cases it will be recognized that references to the "invention" will refer to subject matter recited in one or more, but not necessarily all, of the claims.

Unless the context requires otherwise, throughout the specification which follows, the word "comprise" and variations thereof, such as, "comprises" and "comprising" are to be construed in an open, inclusive sense that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, the particular features, structures, or characteristics may be combined in any suitable manner in one or more embodiments.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

The expression "rating of 2 or above" as used herein throughout the present disclosure, in the context of the fabric tested for pilling after 1000 rubs, generally denotes low pilling tendency of the fabric being tested. Particularly, when the pilling tendency of the finished fabric is measured by any of the standard methods such as ASTM D4970 or ISO 12945-2:2014 and rated on a scale/grade/rating of 1-5, the scale/rating/grade 1 indicating very severe pilling and scale/rating/grade 5 indicating no pilling after the specified number of rubs (e.g. after 1000 rubs or cycles), the fabric exhibits a rating of 2 or 3 or 4 or 5, i.e. the woven textile fabric has low pilling tendency.

The term "woven textile fabric", as used herein throughout the present disclosure in the context of the fabric being tested for pilling tendency or pilling resistance denotes a dyed, bleached or a printed fabric, or otherwise a fabric that is substantially ready for use (e.g. consumer use) without need to be subjected to any further processing that can alter its pilling tendency or pilling resistance. For example, the raw woven fabric may be subjected to dying and/or printing and/or bleaching process(es) to produce the fabric. Such fabric is then subjected to the test for measurement of pilling resistance or pilling tendency.

In some embodiments, the numbers expressing quantities of ingredients, properties such as concentration, and so forth, used to describe and claim certain embodiments of the invention are to be understood as being modified in some instances by the term "about." Accordingly, in some embodiments, the numerical parameters set forth in the written description are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable.

The recitation of ranges of values herein is merely intended to serve as a shorthand method of referring individually to each separate value falling within the range. Unless otherwise indicated herein, each individual value is incorporated into the specification as if it were individually recited herein.

The headings and abstract of the invention provided herein are for convenience only and do not interpret the scope or meaning of the embodiments.

Various terms as used herein are shown below. To the extent a term used in a claim is not defined below, it should be given the broadest definition persons in the pertinent art have given that term as reflected in printed publications and issued patents at the time of filing.

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

The present disclosure pertains generally to the field of textile industry. More specifically, the present disclosure pertains to a woven textile fabric with higher thread count that exhibits low pilling tendency, while being economical.

An aspect of the present disclosure relates to a woven textile fabric, said fabric comprising: a 100% Lyocell warp spun yarn with a yarn count of 30s to 80s; and a 100% recycled multifilament textured polyester weft yarn with a denier of 10D to 140D, wherein the total content of recycled polyester in the fabric is at least about 35%, further wherein said fabric exhibits rating of 2 or above when the fabric is tested for pilling after 1000 rubs.

While any of the methods as known to or appreciated by a person skilled in the art may be used for testing of pilling resistance, particularly preferred are ASTM D4970 and ISO 12945-2. In an embodiment, the fabric exhibits rating of 2 or above when the fabric is tested for pilling for 1000 rubs in accordance with ASTM D4970. In another embodiment, the fabric exhibits rating of 2 or above when the fabric is tested for pilling for 1000 rubs in accordance with ISO 12945-2: 2014. In an embodiment, the fabric exhibits rating of 3 or above when the fabric is tested for pilling for 1000 rubs in accordance with ASTM D4970. In another embodiment, the fabric exhibits rating of 3 or above when the fabric is tested for pilling for 1000 rubs in accordance with ISO 12945-2: 2014. ASTM D4970 and ISO 12945-2 methods make use of a Martindale Tester, wherein the fabric being tested is rubbed face to face for a specified number of rubs/cycles, and the pill balls are evaluated using a photographic visual standard for comparison and given a 1-5 rating, wherein rating/grade 1 indicates very severe pilling and rating/grade 5 indicates no pilling.

In some embodiments, the Lyocell warp spun yarn has a yarn count of 30s to 70s. In some embodiments, the Lyocell warp spun yarn has a yarn count of 40s to 80s. In a preferred embodiment, the Lyocell warp spun yarn has a yarn count of 40s to 60s.

Any conventional recycled multifilament textured polyester yarn can be used to serve its intended purpose as laid down in embodiments of the present disclosure. Preferred are recycled multifilament textured polyester yarns obtained from recycling of PET bottles.

In some embodiments, the recycled multi-filament polyester yarn has a denier of 10D to 140D, for example, between 20D to 140D, 30D to 130D or 40D to 120D. In a preferred embodiment, the recycled multi-filament polyester yarn has a denier of 40D to 120D.

In some embodiments, the total content of recycled polyester in the fabric is at least about 35%, for example, about 40% or about 50% or about 60%. In some embodiments, total content of the recycled polyester in the fabric ranges from about 35% to about 70%, for example, from about 35% to about 60%, preferably, from about 35% to about 50%, more preferably, from about 35% to about 45%, and most preferably, from about 35% to about 43%.

In some embodiments, the fabric comprises 70 to 200 ends per square inch (EPI) Lyocell spun yarns, for example, 80 to 180 ends per square inch (EPI) or 100 to 180 ends per square inch (EPI).

In some embodiments, the fabric comprises 62 to 1300 picks per square inch (PPI) recycled multi-filament polyester yarns, for example, from 65 to 1100 EPI or from 80 to 800 EPI.

In some embodiments, the recycled multi-filament polyester yarn comprises 5 to 40 filaments. In an embodiment, the recycled multi-filament polyester yarn comprises 5 to 30 filaments.

In some embodiments, the fabric has a high total thread count ranging from 162 to 1500, for example, from 200 to 1200 or from 300 to 800.

In an embodiment, the fabric is of a twill weave, a satin weave or a percale weave. In some embodiments, the fabric is of a twill weave. In some embodiments, the fabric is of a satin weave. In some embodiments, the fabric is of a percale weave. In a preferred embodiment, the fabric is of a twill weave.

In some embodiments, the recycled multi-filament polyester yarns are wound, substantially parallel to one another and substantially adjacent to one another, on a multi-pick yarn package at an angle between 15 and 45 degrees, for example, between 15 and 30 degrees or between 15 and 25 degrees, and at a type A shore hardness between 50 to 90, for example, between 60 to 80 or between 50 to 80 to enable simultaneous insertion of the multi-filament polyester yarns during a single pick insertion event of a pick insertion apparatus of a loom. In an embodiment, the recycled multi-filament polyester yarns are wound, substantially parallel to one another and substantially adjacent to one another, on a multi-pick yarn package at an angle between 15 and 25 degrees and at a type A shore hardness between 50 to 90 to enable simultaneous insertion of the multi-filament polyester yarns during a single pick insertion event of a pick insertion apparatus of a loom.

The advantageous fabric realized in accordance with embodiments of the present disclosure can find utility as home textiles. In some embodiments, the woven textile fabric is used as a bedding product, the bedding product being selected from a bed sheet, a pillow case, a comforter, a coverlet, a pillow sham, a dust ruffle, a blanket, a bedspread, and a duvet cover.

The woven textile fabric, realized in accordance with embodiments of the present disclosure can be made by using any apparatus/loom known to a person skilled in the pertinent art. In an embodiment, fabric is produced by using a multi-pick insertion apparatus such as an air-jet or a Sulzer pick insertion apparatus. However, utilization of any other multi-pick insertion apparatus, as known to or appreciated by a person skilled in the art to serve its intended purpose as laid down in the present disclosure, is completely within the scope of the present disclosure.

Table 1 below illustrates properties of the fabric, realized in accordance with embodiments of the present disclosure.

TABLE 1

Characteristics of the Woven Fabric

| Sample No. | Recycled polyester weft (Denier) | Polyester filaments | Lyocell Yarn Count | Recycled polyester content (%) | Piling (1-5) | Tensile Strength (1-10) | Total Thread Count |
|---|---|---|---|---|---|---|---|
| 1 | 120 | 14 | 40 | 35 | 5 | 9 | 180 |
| 2 | 140 | 14 | 40 | 40 | 4 | 8 | 180 |
| 3 | 150 | 14 | 40 | 45 | 3 | 5 | 180 |
| 4 | 50 | 14 | 60 | 35 | 5 | 9 | 400 |
| 5 | 60 | 14 | 60 | 39 | 4 | 8 | 400 |
| 6 | 80 | 14 | 60 | 43 | 3 | 7 | 400 |
| 7 | 100 | 14 | 60 | 48 | 3 | 6 | 400 |

The fabric of the present invention exhibits a low tendency of pilling, while achieving the balance between pilling resistance and the tensile strength. Further, the fabric of the present invention is significantly economical owing to, at least, usage of recycled polyester in a considerable amount.

While the foregoing describes various embodiments of the invention, other and further embodiments of the invention may be devised without departing from the basic scope thereof. The scope of the invention is determined by the claims that follow. The invention is not limited to the described embodiments, versions or examples, which are included to enable a person having ordinary skill in the art to make and use the invention when combined with information and knowledge available to the person having ordinary skill in the art.

ADVANTAGES

The present disclosure provides a textile fabric that overcomes the deficiencies associated with the conventional woven textile fabric.

The present disclosure provides a woven textile fabric that has high thread count.

The present disclosure provides a textile fabric that exhibits high tensile strength and low pilling tendency.

The present disclosure provides a textile fabric that is durable, wrinkle resistant, and comfortable to human skin.

The present disclosure provides a textile fabric that is economical and easy to manufacture.

The present disclosure provides a textile fabric that has enhanced aesthetic characteristics and can be used in a variety of applications.

I claim:

1. A woven textile fabric, said fabric comprising:

a 100% Lyocell warp spun yarn with a yarn count of 30s to 80s; and a 100% recycled multifilament textured polyester weft yarn with a denier of 10D to 140D, wherein the total content of recycled polyester in the fabric is at least about 35%, further wherein said fabric exhibits rating of 2 or above when the fabric is tested for pilling after 1000 rubs.

2. The fabric as claimed in claim 1, wherein the fabric comprises 70 to 200 ends per square inch (EPI) Lyocell spun yarns.

3. The fabric as claimed in claim 1, wherein the fabric comprises 62 to 1300 picks per square inch (PPI) recycled multi-filament textured polyester yarns, and wherein the recycled multi-filament textured polyester yarn comprises 5 to 50 filaments.

4. The fabric as claimed in claim 1, wherein the fabric has a total thread count ranging from 132 to 1500.

5. The fabric as claimed in claim 1, wherein the fabric is of a twill weave, a satin weave or a percale weave.

6. The fabric as claimed in claim 1, wherein the recycled multi-filament textured polyester yarns are wound, substantially parallel to one another and substantially adjacent to one another, on a multi-pick yarn package at an angle between 15 and 45 degrees and at a type A shore hardness between 50 to 90 to enable simultaneous insertion of the multi-filament polyester yarns during a single pick insertion event of a pick insertion apparatus of a loom.

* * * * *